US008584328B2

(12) United States Patent
Maranghi

(10) Patent No.: US 8,584,328 B2
(45) Date of Patent: Nov. 19, 2013

(54) PROCESS FOR PREPARING A NON-WOVEN FABRIC HAVING A SURFACE COVERED WITH MICROFIBER AND FABRIC OBTAINABLE WITH SAID PROCESS

(76) Inventor: Marco Maranghi, Prato (IT)

( * ) Notice: Subject to any disclaimer, the term of this patent is extended or adjusted under 35 U.S.C. 154(b) by 291 days.

(21) Appl. No.: 13/010,323

(22) Filed: Jan. 20, 2011

(65) Prior Publication Data

US 2011/0177296 A1 Jul. 21, 2011

(30) Foreign Application Priority Data

Jan. 21, 2010 (IT) ..... MI2010A0068

(51) Int. Cl.
*D04H 5/02* (2012.01)

(52) U.S. Cl.
USPC ..... 28/104; 28/107

(58) Field of Classification Search
USPC ..... 28/107, 109–114, 104, 105, 165, 167, 28/158, 166; 442/383, 384, 387, 388, 402, 442/408, 346, 403, 407; 156/148
See application file for complete search history.

(56) References Cited

U.S. PATENT DOCUMENTS 6,108,879 A * 8/2000 Forte et al. ..... 28/104
6,624,100 B1 * 9/2003 Pike ..... 442/340
2003/0166371 A1 * 9/2003 Fingal et al. ..... 442/370
2006/0009106 A1 1/2006 Nishimura et al.
2006/0214323 A1 * 9/2006 Chappas et al. ..... 264/138
2009/0258559 A1 * 10/2009 Anantharamaiah et al. .. 442/334
2009/0305593 A1 * 12/2009 Schiavi et al. ..... 442/327
2010/0119794 A1 5/2010 Manstein et al.
2010/0129592 A1 * 5/2010 Nishimura et al. ..... 428/91
2010/0227138 A1 * 9/2010 Ouellette ..... 428/219
2011/0034100 A1 * 2/2011 Narayanan et al. ..... 442/402

FOREIGN PATENT DOCUMENTS

EP 1359241 A1 * 11/2003
WO 2008029307 A2 3/2008
WO 2008141687 A2 11/2008
WO 2009126793 A1 10/2009

OTHER PUBLICATIONS

Italian Search Report, dated Sep. 7, 2010, from corresponding Italian application.

* cited by examiner

*Primary Examiner* — Amy Vanatta
(74) *Attorney, Agent, or Firm* — Young & Thompson

(57) ABSTRACT

There is described a process for preparing a "double layer" non-woven fabric having a non-woven fabric surface covered with microfiber including needle-punching of a mat formed by at least one carded web of macrofibers and at least one carded web of microfibers and subsequent treatment of the mat with high pressure water jets to split the microfibers into filaments.

17 Claims, 1 Drawing Sheet

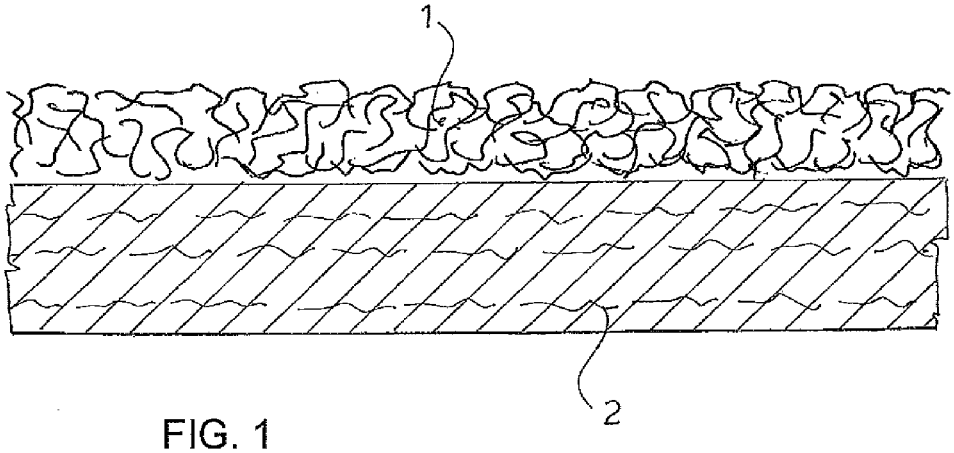
FIG. 1
FIG. 2
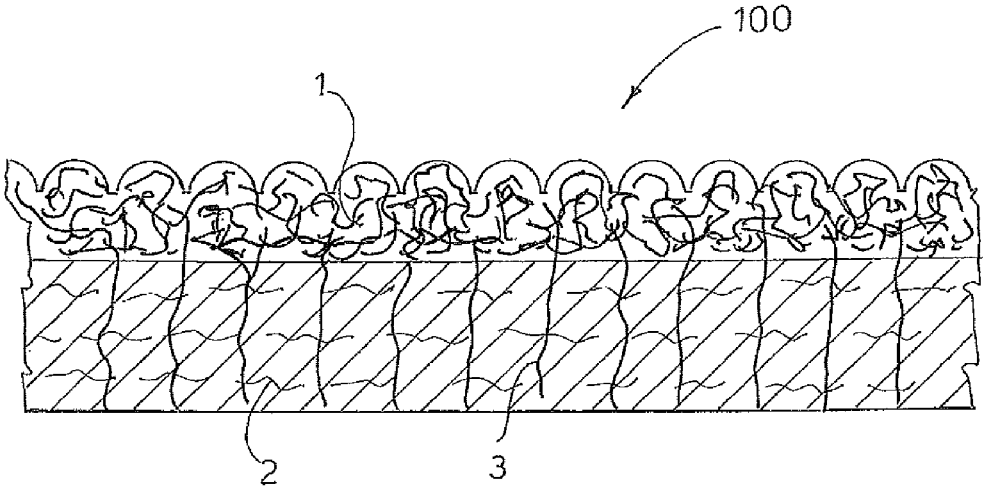

PROCESS FOR PREPARING A NON-WOVEN FABRIC HAVING A SURFACE COVERED WITH MICROFIBER AND FABRIC OBTAINABLE WITH SAID PROCESS

FIELD OF THE INVENTION

The present invention relates to a process for preparing a non-woven fabric having a surface covered with microfiber that can advantageously be used to produce cleaning cloths and mops. In particular, the present invention relates to a process for preparing "double layer" composite textile materials formed by a microfiber surface layer and a non-woven fabric supporting layer.

BACKGROUND OF THE INVENTION

There are known procedures for the production of non-woven fabrics produced with mechanical needle-punching and spunlace or hydroentangled technologies and/or optionally subsequently bonded by means of thermal bonding of thermoplastic fibers and/or by adding resins or latexes in general.

These non-woven fabrics are used to produce cleaning cloths or to produce mops. According to prior art techniques to produce needle-punched non-woven felts with mechanical needle-punching systems, these felts are optimally used to produce cleaning cloths, and have the advantage of having a low density and consequently a relatively high volume with respect to the weight per square meter. Moreover, regardless of the type of fibers used, their mass creates a mechanical volume that increases their absorption capacity. Their volumetric mass with low weight density per $cm^3$ also allows the production of articles such as mops or swabs that must have a volume in addition to a cleaning surface. Cloths obtained with this process are formed by fibers with a fineness greater than 1 dtex (macrofibers) and are produced by subjecting both surfaces of the fiber layer to mechanical needle-punching, optionally followed by a thermal bonding process to increase the mechanical consistency of the cloth, or using chemical binders such as acrylic resins, EVA, rubber latexes and the like by means of spray application, impregnation using padding machines or by coating or the like according to prior art. The disadvantage of this type of technology if used to produce microfiber non-woven fabrics is that the majority of the fibers remain inside the thickness of the non-woven fabric and accordingly their cleaning capacity is not used: therefore costs are also higher due to the use of microfibers for the whole thickness of the non-woven fabric structure.

With another prior art technique, known as spunlace or hydroentangled, non-woven fabrics are produced with a higher weight density, generally greater than 0.16 $g/cm^3$, with respect to those produced through the mechanical needle-punching process: these fabrics have the characteristic of greater compactness and low thickness with respect to non-woven fabrics produced with mechanical needle-punching systems having the same basis weight per square meter and the same fiber composition. Said process is generally used to produce microfiber non-woven fabrics as it also splits the splittable microfiber into filaments: it is performed on both surfaces of a mat of extruded continuous filaments deriving from microfibers coming from production systems using spunbonded and/or meltblow technologies or from staple fiber mats coming from carding systems.

The drawback of this production process is that to obtain a thickness that is sufficiently high to allow easy handling for use as cleaning cloths, or to produce strip mops, the weight per square meter of the product must be greatly increased, thus increasing costs due to the quantity of fibers used. Moreover, increasing the weight of the product in this way leads to high production costs, as high pressure water jets are required during the hydroentanglement process to achieve bonding of the fibers inside the layer of non-woven fabric.

Another type of non-woven fabric is represented by microfiber and macrofiber bonded materials produced by thermal bonding of a microfiber layer with a macrofiber layer, optionally subsequently calendering the double layer thus obtained, where each layer has been prepared previously according to the techniques described above. However, this thermal process is costly from the viewpoint of energy and due to the use of hot melt glues which are required to allow adhesion of the two different layers.

SUMMARY OF THE INVENTION

The object of the present invention is to produce a non-woven fabric for cleaning cloths using a process capable of solving and overcoming all the aforesaid drawbacks of prior art.

A further object is that of providing a process of this type that can also be used to obtain a double-layer textile material in which the layers have very different unit weights or densities from each other, guaranteeing sufficient mechanical consistency of the material without macrofiber impurities on the microfiber surface.

Yet another object of the present invention is to provide a process to obtain a double-layer textile material in which the microfiber layer is thin without decreasing the cleaning power of the non-woven fabric.

These objects are achieved by a process in accordance with the invention having the characteristics listed in the appended independent claim 1.

Advantageous embodiments of the invention are apparent from the dependent claims. The present invention relates to a process for preparing a non-woven fabric material, where a supporting layer is bonded with a microfiber cleaning layer, comprising:

(a) needle-punching of a mat formed by at least one layer of carded web of macrofibers and at least one layer of carded web of microfibers, and (b) treatment of the needle-punched mat by means of spunlace/hydroentangled technology with high pressure water jets to split the microfibers into filaments.

The needle-punching (a) and the subsequent treatment (b) are performed and applied from the same side and, i.e. only on the free side (i.e. the side not in contact with the microfibers) of the microfiber layer of the bonded non-woven fabric material.

The macrofiber layer to be used in step (a) can be pre-needled, needle-punched or even only constituted by a plurality of folded or carded webs. The effect of the use of the macrofiber layer is achieved provided that a microfiber web layer is deposited over said macrofiber layer and that subsequent needle-punching (a) is performed only from this microfiber side.

In practice, the first mechanical needle-punching step produces a non-woven fabric, which is used as base for application to one of the two surfaces of a splittable fiber web, in this case splittable microfibers and, again with the prior art mechanical needle-punching technique, this surface web of fibers is entangled to take, through mechanical action, the fibrils of the microfiber inside the lower layer of non-woven fabric so as to cover one of the two surfaces and to bond the two layers of non-woven fabric though entanglement of the fibrils of the surface layer with those of the layer below. In this manner, the fibril is given its direction by the needle that conveys it inside the lower supporting layer, without contaminating the microfiber layer with less prestigious macrofibers, which instead would occur in the case of bonding only using mechanical needle-punching, as in the art needle-punching is also performed on the other side (lower) of the material. Following this operation, surface bonding is applied using the prior art technique of hydroentanglement, again only from one side on which the microfibers have been deposited so as to entangle the fibres of the surface and in the case of microfibers, also to split the fibrils so as to produce microfibers as a result of hydroentanglement.

The non-woven fabric thus produced can be used as is, or can be subsequently dyed and/or coated on one or both sides and/or printed, to produce dry and/or moistened cloths for cleaning, to produce mops or for uses in the medical sector, where fabrics with different densities and compositions are required, and in all those applications that require the efficacy of microfiber which, due to the physical structure of the fibers of which it is composed, removes dirt very effectively.

BRIEF DESCRIPTION OF THE DRAWINGS

Reference shall now be made to the accompanying FIGS. 1 and 2, which represent schematically in cross section, respectively the textile material before step (a) and after the process in order to better illustrate the present invention.

DETAILED DESCRIPTION OF THE INVENTION

The term "bonded material" 100, illustrated in FIG. 2, is intended herein to identify a material composed of two superimposed layers 1 and 2 formed by different fibers that have been subjected to processing through which they have been mutually bonded. The mechanical needle-punching step (a) is carried out according to prior art.

The treatment with high pressure water jets used in step (b) of the present process is a technology known in the art also called spunlacing or hydroentangling. See for example U.S. Pat. No. 3,485,706, or the description of patent application EP 1359241 incorporated herein by reference.

The non-woven fabric 100 is prepared according to the following procedure: the fibres constituting the supporting layer 2, having deniers greater than 1 dtex (illustrated with a light line), are fed on a conveyor belt from a first carding system. The fibers of said supporting layer 2 are then bonded, for example with water jets or mechanical needle-punching, as in the carded web the fibers are maintained joined through mutual bonding but break up and separate if subjected to traction.

The splittable microfiber fibers (illustrated with a heavy line) are fed from a second carding system in the form of one or more air-formed webs, on top of the free surface of the previously formed macrofiber supporting layer 2. By means of the needle-punching operation (a) of the mat formed by two layers 1 and 2 which is positioned on the conveyor belt, part of the microfibers of the upper layer 1 are driven and bonded with part of the macrofibers of the lower layer 2, as illustrated in FIG. 2. In this way part of the microfiber fibers of the layer 1 are bonded with part of the fibers of the lower supporting layer 2 below as the needle drives the fibrils 3 from the upper layer 1 to the lower layer 2 for the entire depth (thickness) of the material (mat) creating a coupling point between the two layers as shown in FIG. 2.

Then, by means of a device with high pressure water jets, pressure is applied to the free surface of the upper layer 1 of the mat 100 along the lines of the nozzles to perform step (b); said lines represent longitudinal bonding lines along which the microfibers are bonded to a greater degree with the macrofibers below. In this bonding operation final entanglement of the microfibers occurs, with formation of the cleaning layer fixed to the supporting layer, at said longitudinal bonding lines, preferably spaced apart from one another so that they are alternated. Along said lines the fibres are more compressed due to the water jet and therefore, when the lines are spaced apart, the microfiber surface has embossments or micro-embossments (illustrated in FIG. 2 without reference numeral) alternated with said lines that represent grooves. In this step (b) very fine water jets are used with pressures up to 80/400 bar produced by hydraulic injectors (or spray nozzles) distributed in various ways, mutually adjacent and in contact with one another, or suitable spaced apart so as to create different paths. In practice the high energy of the water jets is transferred to the fibers, bonding them. Subsequently, the bonded material obtained is air-dried and wound on a reel or can be coated with resins, preferably acrylic resins, on the macrofiber side to obtain fabrics with one side similar to chamois leather, which are very effective for cleaning glass.

Macrofibers can be used as fibers for the lower layer 2, with the same or different density, made of viscose, polypropylene, nylon, rayon, cellulose, mixed viscose and polyester, cotton and the like, or alternatively, of regenerated or recycled materials, for example 100% recycled PET, or of a mixture of 70% regenerated cellulose fibres and 30% recycled PET fibres. A preferred composition of macrofibers contains 70% of viscose and 30% of polyester, or a 50/50 mixture of viscose/polyester.

The unit weight of the macrofiber layer 2 can range from 50 $g/m^2$ to 300 $g/m^2$, preferably greater than 100 $g/m^2$, for example comprised between 180 and 280 $g/m^2$, more preferably comprised between 200 and 250 $g/m^2$. It is understood that macrofibers with greater unit weight, such as 400 $g/m^2$, could also be used without departing from the spirit of the present invention.

The fibers of the microfiber layer 1 are, as stated, preferably splittable fibers formed, for example, by polyester/polyamide, having deniers of around 1-2 Dtex before being split and capable of generating microfilaments (multi filaments) having deniers below 1 Dtex. This microfiber can have a unit weight similar to that of the macrofiber layer 2 or lower, preferably lower, for example comprised between 40-70 $g/m^2$.

A preferred embodiment of the textile material obtained by the present process provides a microfiber layer 1 with unit weight comprised between 60-70 $g/m^2$ and a non-woven fabric macrofiber layer 2 with unit weight comprised between 200 and 250 $g/m^2$.

The total thickness of the textile material and/or of its single layers is not binding for the purposes of the present invention. For example, to produce mops, a non-woven fabric with total thickness from 1 mm to 3 mm and with a thickness of the microfiber layer from 0.3 mm to 1 mm can be used.

Numerous advantages can be achieved due to the present process. In fact, it is possible to use a microfiber with low unit weight as the mechanical resistance of the material is given by the less prestigious macrofiber layer 2, thus using a smaller quantity of microfiber with consequent reduction of costs. Moreover, an economic saving is obtained with respect both to the thermal bonding process and to a conventional spunlace process, as due to the initial bonding performed with mechanical needle-punching, lower water pressures can be used.

Moreover, the presence of embossments on the microfiber surface provides an improved cleaning power with respect to conventional microfiber cloths as it is even rougher and more abrasive with a "spatula" effect that allows more effective removal of dirt and grease with respect to conventional microfiber cloths.

The materials obtainable from the present process can be used as non-woven fabric to produce cleaning devices and/or medical textiles, for example to produce mops, conventional floor cloths, cloths for glass and for any other type of surface, sponges, dry and/or moistened cloths for cleaning, or cloths for use in the medical sector where fabrics with different densities and compositions are required, and in all those applications in which the efficacy of microfiber is required.

In practice the non-woven fabric material 100 formed by a microfiber cleaning layer 1 and a macrofiber supporting layer 2, wherein said layers are bonded by needle-punching and subsequent treatment of the microfiber surface with high pressure water jets, and provided with the technical characteristics described above, such as thickness, total unit weight or weight of the single layer, materials, the presence of embossments, etc., is particularly suitable for producing cleaning devices and/or medical textiles, said material being preferably obtainable from the process as described above.

Numerous modifications and variations of detail within the range of those skilled in the art could be made to the present embodiment of the invention, all however falling within the scope of the invention expressed by the appended claims.

The invention claimed is:

1. A process for preparing a non-woven fabric material comprising a microfiber surface layer bonded to a macrofiber supporting layer, the method comprising:

(a) needle-punching a mat formed by at least one layer of carded web of said macrofibers and at least one layer of carded web of said microfibers, and (b) treating the needle-punched mat with high pressure water jets to bond the surface layer to the supporting layer by spunlacing and hydroentangling the microfibers of the surface layer with the macrofibers of the supporting layer, and to split the microfibers into filaments, wherein said needle-punching (a) and said water jet treating (b) steps are both performed from a same side of the fabric material on a free surface of the microfiber layer that is not in contact with the macrofiber layer.

2. The process according to claim 1, wherein the macrofibers of the supporting layer have a denier greater than 1 dtex, and prior to step (a), the macrofibers are fed on a conveyor belt from a first carding system and are bonded to form the supporting layer.

3. The process according to claim 2, wherein the microfiber surface layer comprises splittable microfibers deriving from a second carding system in the form of one or more air-formed carded webs, and the microfibers are fed on top of a free surface of the macrofiber supporting layer positioned on the conveyor belt.

4. The process according to claim 1, wherein the bonded material obtained from step (b) is air-dried and wound on a reel or coated with resins on the macrofiber side.

5. The process according to claim 1, wherein the fibers of the supporting layer are macrofibers made of viscose, polypropylene, nylon, rayon, cellulose, mixed viscose and polyester, or cotton.

6. The process according to claim 1, wherein the unit weight of the macrofiber layer ranges from 50 g/m$^2$ to 300 g/m$^2$.

7. The process according to claim 1, wherein the fibers of the microfiber layer are splittable fibers formed from polyester, polyamide or a combination thereof.

8. The process according to claim 1, wherein the unit weight of the microfiber layer is between 40-70 g/m$^2$.

9. The process according to claim 1, wherein in step (b) the injectors are spaced apart from one another so as to generate longitudinal bonding lines alternated with embossments on the surface of the microfiber layer.

10. The process according to claim 1, wherein the microfibers of the microfiber layer have a denier of 1-2 dtex, before being split into filaments.

11. The process according to claim 1, wherein the filaments have a denier of less than 1 dtex.

12. The process according to claim 2, wherein the macrofibers are bonded to form the supporting layer with water jets or by mechanical needle-punching.

13. The process according to claim 1, wherein the macrofibers are formed from regenerated or recycled materials.

14. The process according to claim 1, wherein the macrofibers are formed from 100% recycled PET or a mixture of 70% regenerated cellulose fibers and 30% recycled PET fibers.

15. The process according to claim 1, wherein the fibers of the supporting layer formed from a viscose/polyester mixture.

16. The process according to claim 1, wherein the unit weight of the macrofiber layer is between 200 and 250 g/m$^2$.

17. The process according to claim 1, wherein the unit weight of the microfiber layer is between 60-70 g/m$^2$.

* * * * *